US005607363A

United States Patent [19]

Chou

[11] Patent Number: 5,607,363

[45] Date of Patent: Mar. 4, 1997

[54] GOLF CLUB HEAD WITH LOCATED HOSEL

[75] Inventor: Arthur C. P. Chou, Oceanside, Calif.

[73] Assignee: Acushnet Company, Fairhaven, Mass.

[21] Appl. No.: 445,232

[22] Filed: May 19, 1995

[51] Int. Cl.[6] ..... A63B 53/04

[52] U.S. Cl. ..... 473/287; 473/290

[58] Field of Search ..... 273/77 A, 78, 273/169, 170, 171, 172, 173, 167 D, 167 E, 167 F, 167 G, 167 H, 167 K, 80.2, 80.3–80.9; 473/287, 289, 290, 291, 292

[56] References Cited

U.S. PATENT DOCUMENTS

| | | | |
|---|---|---|---|
| 3,762,717 | 10/1973 | Johnston . | |
| 3,947,041 | 3/1976 | Barber . | |
| 3,967,826 | 7/1976 | Judice . | |
| 4,621,813 | 11/1986 | Solheim . | |
| 4,695,054 | 9/1987 | Tunstall . | |
| 4,848,747 | 7/1989 | Fujimura et al. . | |
| 4,895,367 | 1/1990 | Kajita et al. | 273/77 A |
| 4,913,435 | 4/1990 | Kobayashi | 273/77 A |
| 4,955,610 | 9/1990 | Creighton et al. . | |
| 4,986,541 | 1/1991 | Teramoto et al. . | |
| 5,046,733 | 9/1991 | Antonious . | |
| 5,160,136 | 11/1992 | Eger . | |
| 5,193,805 | 3/1993 | Solheim . | |
| 5,230,510 | 7/1993 | Duclos . | |
| 5,312,105 | 5/1994 | Cleveland . | |
| 5,312,106 | 5/1994 | Cook | 273/169 |
| 5,326,106 | 7/1994 | Meyer | 273/167 H |
| 5,333,860 | 8/1994 | Saito et al. | 273/77 A |
| 5,333,862 | 8/1994 | Teramoto et al. . | |
| 5,375,840 | 12/1994 | Hirsch et al. | 273/77 A |
| 5,433,439 | 7/1995 | Hsien | 273/77 A |

FOREIGN PATENT DOCUMENTS

| | | |
|---|---|---|
| 2042573 | 2/1995 | United Kingdom . |

*Primary Examiner*—Steven B. Wong
*Attorney, Agent, or Firm*—Pennie & Edmonds

[57] ABSTRACT

An iron golf club set comprising a plurality of clubs with varying lofts and insets, in which the inset of each club is equal to or less than the inset for the next club in the set with less club loft and there are at least three different insets within the set. In a preferred embodiment, the plurality of clubs have offsets, in which the offset of each club is equal to or less than the offset for the next club in the set with less club loft and there are at least three different offsets within the set.

19 Claims, 6 Drawing Sheets

GOLF CLUB HEAD WITH LOCATED HOSEL

BACKGROUND OF THE INVENTION

The present invention relates to golf club irons and, more particularly, to a set of golf club irons having located hosels.

Generally, golf club iron heads are formed with an integral hosel for receiving the golf shaft. As shown in FIG. 1, prior art clubs include a heel 1*h*, a toe it and a ball-striking surface 2 therebetween. In general, clubs include a club hosel 4 that extends from the club heel 1*t* to receive the club shaft.

The applicant's copending U.S. patent application titled "INSERTABLE HOSEL EXTENSION FOR VARYING OFFSET AND INSET OF GOLF CLUBS" and filed on Jan. 13, 1995 discloses a transitional hosel that can be used to vary the inset and/or offset of a club during manufacturing. Once the desired inset and/or offset is determined, the transitional hosel is set in the standard club hosel. The applicant's copending U.S. patent application Ser. No. 08/350,771 is directed to a golf club having offset and inset. Both of these applications are incorporated herein by reference.

Under USGA (United States Golf Association) rules the perpendicular distance between the axis of the club shaft and the heel or back of the head of the club head must not exceed 0.625 inch (15.8 mm). In other words, the inset of a club cannot be greater than 0.625 inch.

Prior iron club heads and hosels have generally been constructed of metal, such as stainless steel, with the head having greater depth near the toe to accomplish balancing of the weight of the hosel. Such balancing has placed the center of weight at or near the geometric center of the striking face.

SUMMARY OF THE INVENTION

Broadly, the present invention is a golf club iron set with progressive inset such that the club inset decreases as loft increases throughout the set. Preferably, the invention is directed to an iron set wherein the inset and offset of the iron heads are progressive throughout the iron set.

It is a feature of the present invention that when the hosel extends from the club, it may include at least two portions, an upward extending portion and a shaft-receiving portion. These portions can define the club inset and/or offset. The upwardly-extending portion of the hosel extends from approximately the club heel at an angle that is approximately perpendicular to the ground (a flat plane) when the club is properly addressed. The shaft-receiving portion includes a bore for attachment to a shaft and extends in alignment with such shaft. The hosel can further include a base portion interposed between the hosel upward-extending portion and the club heel. The base portion preferably extends generally parallel to the shaft-receiving portion, but can also extend forward from the club heel to form offset.

The invention may be incorporated into conventionally shaped clubs, clubs in which at least one of the heads of the set has added weight in the sole or clubs in which at least one of the clubs has a hosel portion made from a material that is of a lower portion of the hosel extends from approximately the club heel at an angle that is approximately perpendicular to the ground (a flat plane) when the club is properly addressed. The shaft-receiving portion includes a bore for attachment to a shaft and extends in alignment with such shaft. The hosel can further include a base portion interposed between the hosel upward-extending portion and the club heel. The base portion preferably extends generally parallel to the shaft-receiving portion, but can also extend forward from the club heel to form offset.

The invention may be incorporated into conventionally shaped clubs, clubs in which at least one of the heads of the set has added weight in the sole or clubs in which at least one of the clubs has a hosel portion made from a material that is of a lower density than the iron head.

BRIEF DESCRIPTION OF THE PREFERRED EMBODIMENTS

Figure 1:
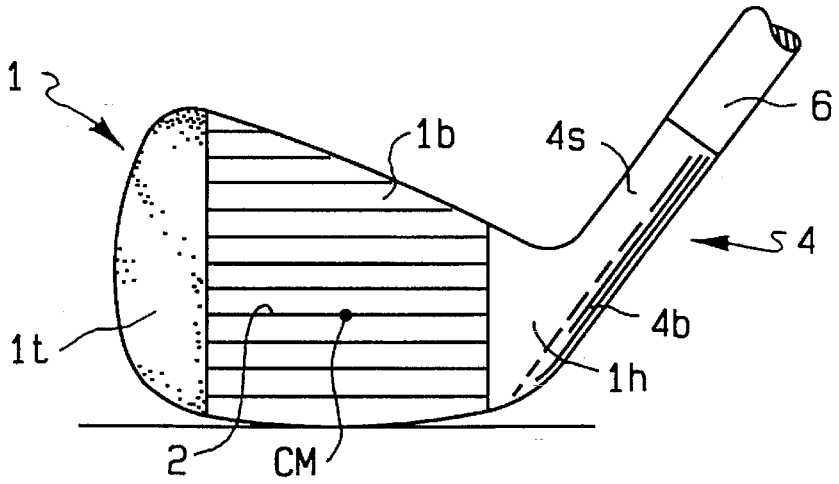
FIG. 1 (Prior Art)
FIG. 1 depicts a front view of a prior art iron head with a hosel and shaft portion.
Figure 2:
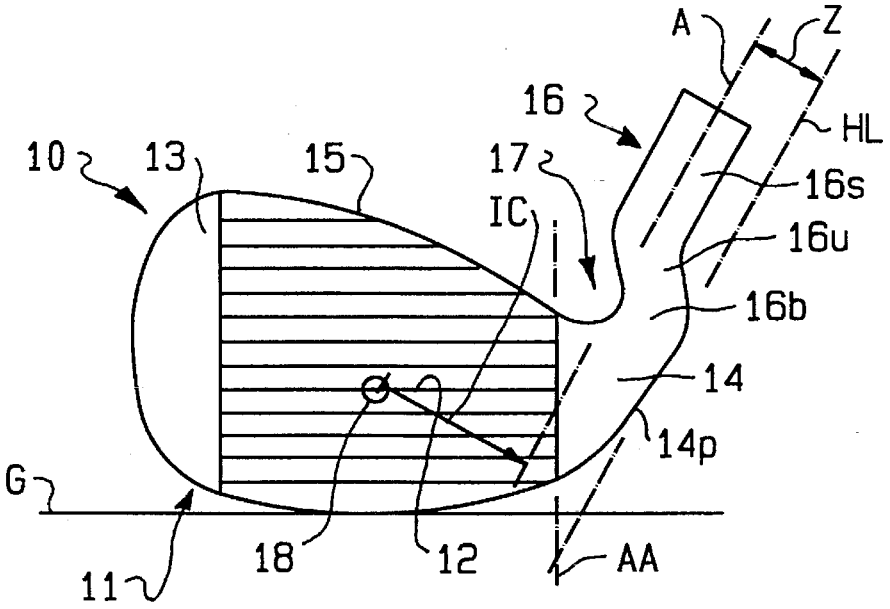
FIG. 2 is a view similar to FIG. 1 showing a club head and hosel in accordance with the present invention.

In FIG. 1, a prior art golf club iron head 1 includes a body portion 1*b* which has the ball-striking surface 2. Generally, the center of mass CM for the head is located in the center of the surface 2. Head 1 further includes toe 1*t*, heel 1*h*, and hosel 4. The hosel 4 is comprised of a lower base portion 4*b*, which extends from the heel 1*h*, and upper shaft-receiving portion 4*s* which receives shaft 6.

Turning to FIGS. 2–5, a first embodiment of the present invention is shown as golf club head 10. Head 10 includes body 11 with a grooved ball striking surface 12 and geometric center 18 that are between the club toe 13 and heel 14. Head 10 also includes hosel 16 with hosel base portion 16*b*, hosel shaft-receiving portion 16*s* and hosel upwardly-extending portion 16*u* therebetween. The hosel base portion 16*b* and hosel shaft-receiving portion 16*s* are preferably about parallel along the shaft centerline A. The hosel upwardly-extending portion 16*u* is substantially vertical or perpendicular to the ground G when the club 10 is properly addressed.

Heel 14 includes a point 14*p* that is the point through which a heel line HL passes. Heel line HL is the line parallel to the axis A of the hosel shaft-receiving portion 16*s* (and the club shaft which is not shown) that is closest to the golfer when the club is addressed and still intersects a point on the club head 11. Distance Z is the inset of hosel 16 and is defined as the perpendicular distance between the centerline A (of the shaft and of hosel shaft-receiving portion 16*s*) and heel line HL. Thus, in the prior art club shown in FIG. 1, where the heel line HL extends up the back surface of the hosel, the inset is equal to the radius of the hosel.

Figure 10:
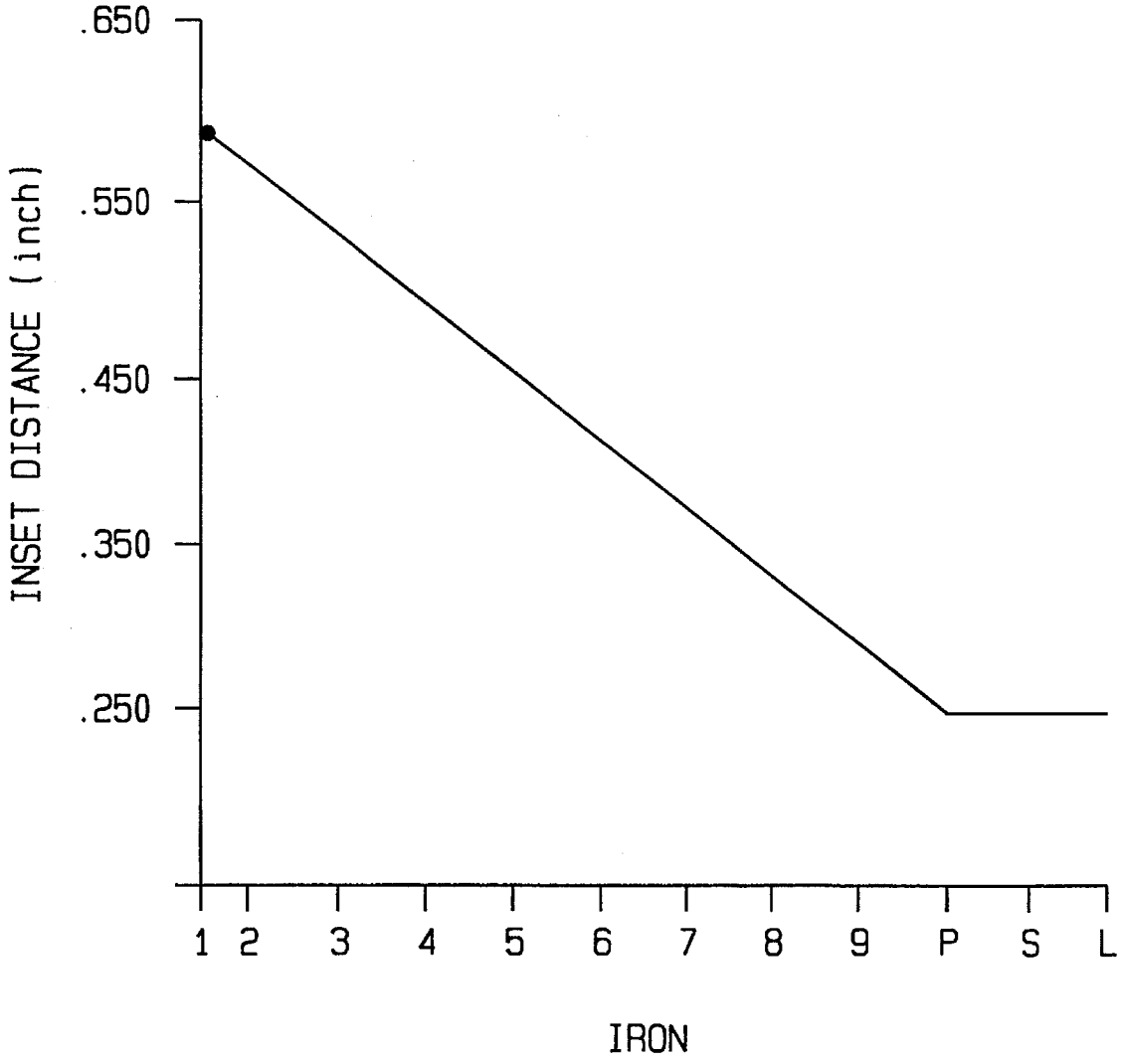
FIG. 10 is a graph showing the relationship of the club head loft and inset.

The preferred inset for a set of irons in accordance with the present invention is set forth in Table 1. FIG. 10 is a graph that depicts another embodiment of the present invention where the irons have linear progressive inset. In either embodiment, the inset for the set of irons is progressive, i.e., the inset is equal to or less than the inset for the next higher club (next club with less loft) and, through the set, there are at least three different insets.

In the preferred embodiment, the inset Z of each club is proportional to the height W of the upwardly-extending hosel portion 16*u*. The greater the height W of the upwardly-extending hosel portion 16*u*, the more inset the iron will have.

Figure 3:
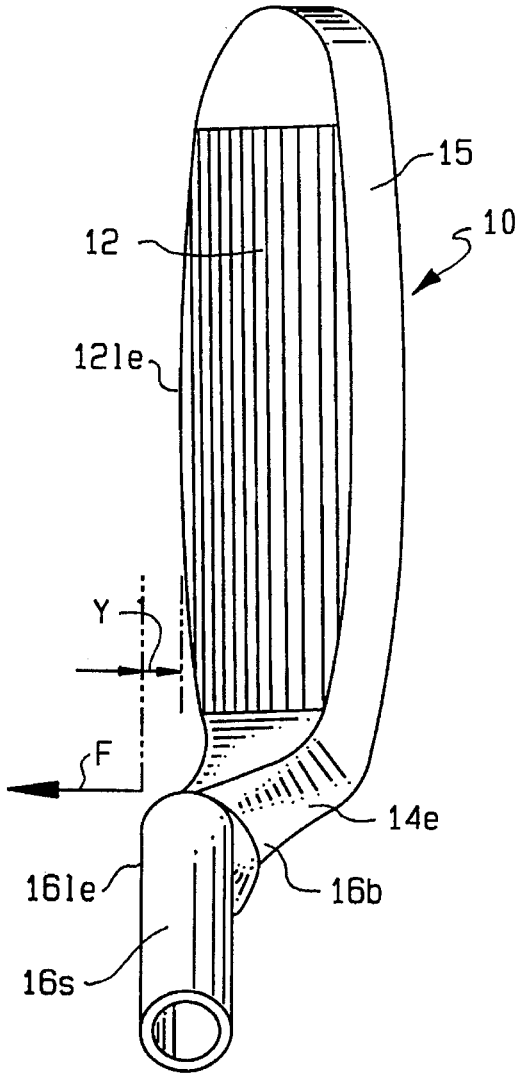
FIG. 3 is a top view of the club head and hosel of FIG. 2.

As shown in FIG. 3, the ball striking surface 12 includes a leading edge 12*le*. The hosel 16 includes a hosel leading edge 16*le*. Distance Y is the offset of hosel 16 and is defined as the distance between the vertical plane through the leading edge 12*le* and the vertical plane through the hosel leading edge 16*le*. The offset of a set of irons in accordance with the preferred embodiment of the present invention is also progressive, i.e., the offset is equal to or less than the offset for the next higher club (next club with less loft) and, through the set, there are at least three different offsets. The preferred offsets for a set of irons according to the present invention are set forth in Table 1.

The club 10 includes a top surface 15 that extends from the toe 13 to the heel 14. In the preferred embodiment, the hosel 16 extends from the heel 14 rather than the top surface 15. Further, heel extension 14*e* includes a reduced hosel notch area 17. The notch 17 is located between the top surface 15 and the hosel upwardly-extending portion 16*u* to reduce the weight of the hosel 16.

Figure 5:
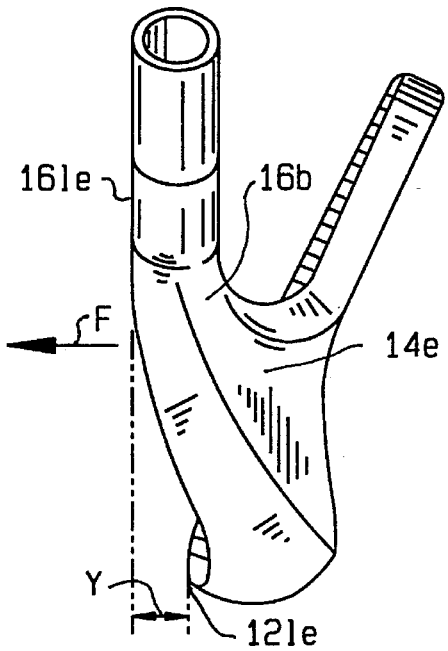
FIG. 5 is a back view of the club head and hosel of FIG. 2.

The heel extension 14*e* is a flange member that extends from the club heel 14 approximately perpendicular to the club leading edge 12*le* which is a forward direction F as shown in FIG. 3 and 5. The distance that the heel extension 14*e* protrudes from the club heel 14 will at least contribute to the offset of the club. Alternatively, the hosel base portion 16*b* can extend from the heel extension 14*e* at least partially in the forward direction F, i.e. the direction substantially perpendicular to the club leading edge 12*le*, to assist in creating club offset.

TABLE 1

| Iron | Inlet | Offset |
|---|---|---|
| 1. | .625" | .363" |
| 2. | .625 | .363 |
| 3. | .625 | .330 |
| 4. | .625 | .297 |
| 5. | .625 | .264 |
| 6. | .550 | .231 |
| 7. | .475 | .198 |
| 8. | .400 | .165 |
| 9. | .325 | .132 |
| PW | .250 | .099 |
| SW | .250 | −.01* |
| LW | .250 | −.01* |

*The negative offset means that the club leading edge 12le is more forward than the hosel leading edge 16le.

Preferably, in a set of irons, the inset of the long irons, i.e., the 5 iron and higher, will be greater than 0.450 inch and the inset for the low irons, i.e., the 8 iron and lower, will be less than 0.450 inch. More preferably, in a set of irons, the inset for the long irons is between 0.450 and the maximum allowed by the USGA rules, the inset for the middle irons, i.e., the 6 and 7 irons, is between 0.350 and 0.600 inch and the inset for the low irons is between 0.250 and 0.450 inch.

Still further, in the preferred embodiment, the combined inset and offset for the long irons is greater than 0.700 inch and the combined inset and offset for the low irons is less than 0.700 inch. More preferably, the combined inset and offset for the long irons is greater than 0.800 inch, the combined inset and offset for the middle irons is between 0.600 and 0.800 inch and the combined inset and offset for the low irons is less than 0.600 inch. Still further yet, in the preferred set of irons, there are at least four different and progressive insets and, more preferably, there are at least six different and progressive insets. Also in the preferred set of irons, there are at least four different and progressive offsets. More preferably, there are at least six different and progressive offsets in the set and, most preferably, there are at least eight different and progressive offsets within a set.

In the present construction, the inset is the distance between the axis of the club shaft (or the shaft receiving portion of the hosel) and the heel tip. Measuring in the other direction, the distance from the axis of the shaft (CL or A) perpendicularly to the center of gravity is the distance IC in FIGS. 2 and 9. The distance IC preferably increases as the loft of the irons in a set increases. The progressive inset through a set of irons assists in creating a more dramatic increase of the distance IC though a set of irons. Golf club iron heads generally increase in length, from the heel to the toe, inversely with iron loft and the lie angle generally increases. These factors generally create a distance IC that increases though a set with the loft of the club. However, the present invention further increases the IC distance with the loft of clubs by the amount of decrease in the inset and offset of the clubs through the set.

The IC distance is inversely related to the golfer's ability to close the club face at impact. Thus, a smaller IC distance for long irons makes it easier to close the club at impact while a larger IC distance for the short irons makes it more difficult to close the club at impact. The average golfer tends to slice the ball, which is often a result of not closing the club face enough at impact. Average golfers also generally have more trouble in closing long irons at impact than they do the short irons. Therefore, an IC "progression" calls for a smaller IC in the long irons and progresses to a larger IC value in the short irons to help the average player close the club face at impact uniformly through the entire set.

Furthermore, by introducing offset to a club, the club ball-striking surface is further behind the shaft as the club goes through impact. This gives the player more time to close the club face at impact.

Figure 7:
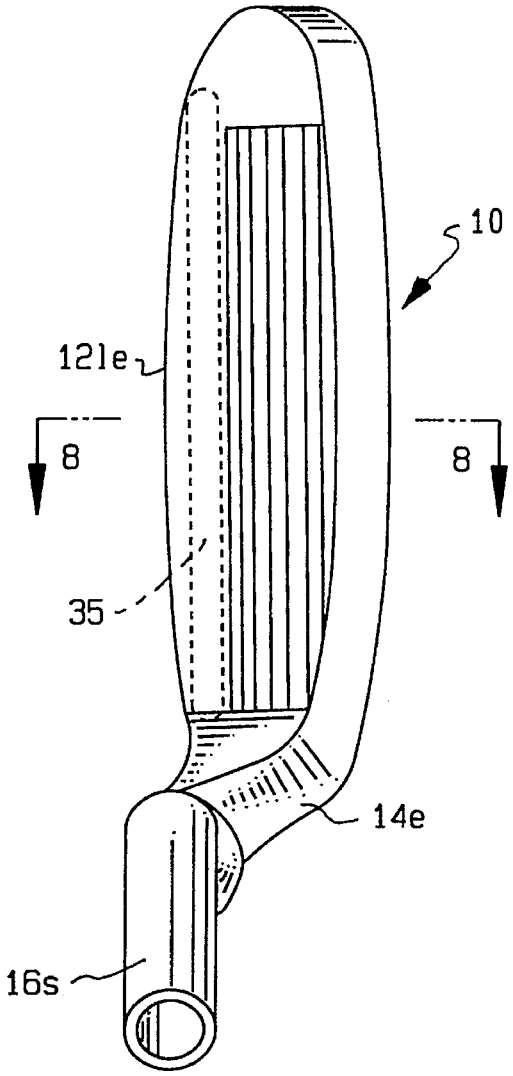
FIG. 7 is a top view of the second embodiment club head of FIG. 6.
Figure 4:
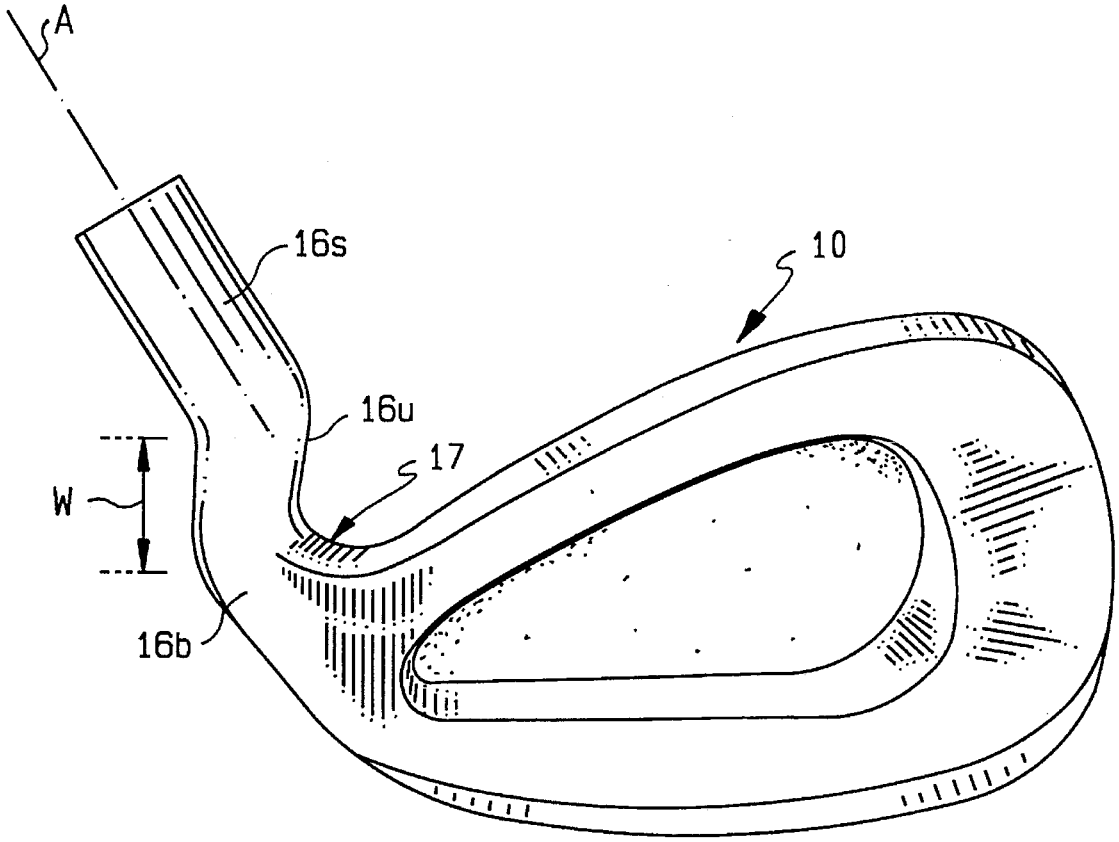
FIG. 4 is a rear view of the club head and hosel of FIG. 2.
Figure 6:
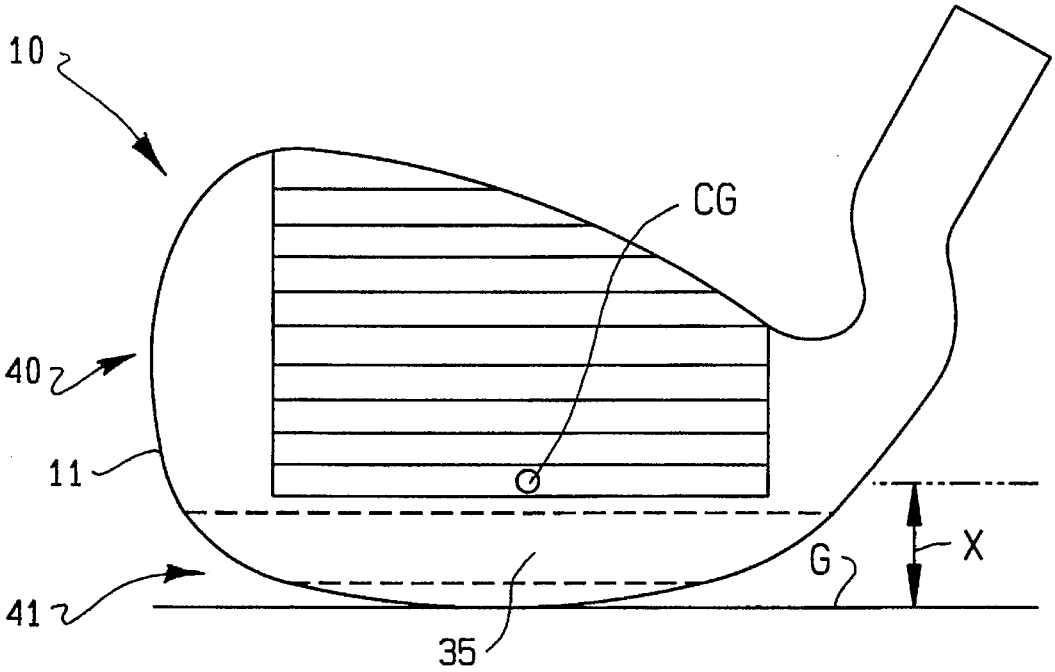
FIG. 6 is a front view of a second embodiment club head and hosel in accordance with the present invention.
Figure 8:
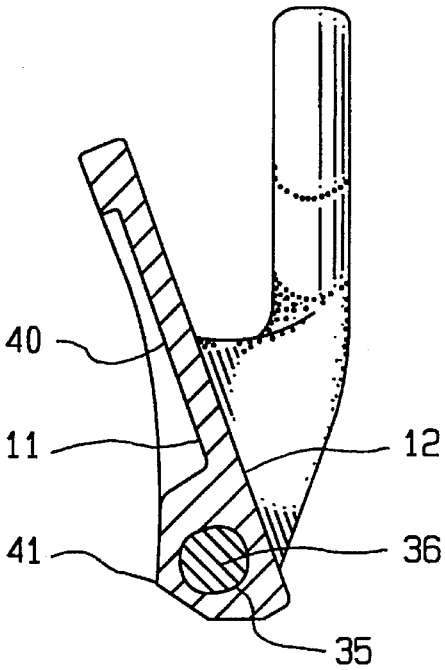
FIG. 8 is a cross-sectional view taken along line 8—8 of FIG. 7.

Turning to a second embodiment of the present invention as shown in FIGS. 6–8, golf club 10 is substantially the same as disclosed above, but includes a bore 35 in the club sole for receiving a high density bar 36. The high density bar 36 is made of a material that has a greater density than the material of the head body 11. Preferably, the head 11 is made from titanium and the bar 36 is made from molybdenum, tantalum or tungsten. In order for the bar 36 to be cast into the head 11, the melting temperature of the bar 36 should be greater than the head 11.

The club 11 is generally comprised of two portions, a body portion 40 and a sole portion 41. Since the high density bar 36 is added to the sole portion 41, the sole portion 41 has a higher average density than the body portion 40. This provides the club with lower center of gravity. More preferably, densities are proportioned so that the center of gravity is a distance X above the ground that is approximately one-half of a standard ball diameter.

Figure 9:
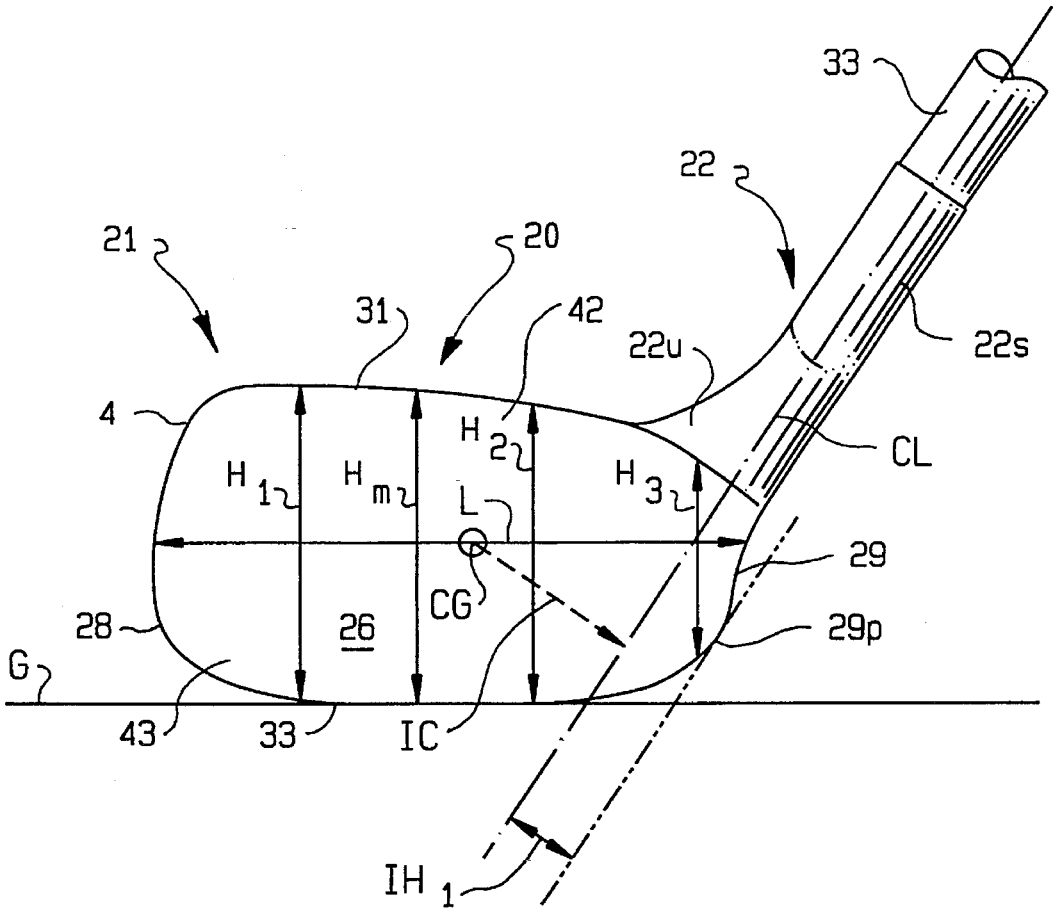
FIG. 9 is a front view of a third embodiment club head and hosel in accordance with the present invention.

Turning now to a third embodiment of the present invention as shown in FIG. 9, golf club 20 has a head 21 and a hosel 22. Hosel 22 which includes an upwardly-extending portion 22*u* and shaft-receiving portion 22*s*. Head 21 includes striking surface 26, toe 28 and heel 29. Head 21 also has an upper top line surface 31 and sole 33.

Head body 21 is composed of a metal and hosel 22 is preferably composed of plastic, composite comprising carbon-granite fibers or other materials of less density than the club head 21 to accomplish a balance of weight so that the center of gravity (CG) is substantially on line L that passes through the center of gravity CG.

By using the construction of a metal in body 21 and a less dense hosel 22, the depth or height of the striking face can be made wider in the heel-to-toe direction while maintaining the desired head weight. Height distances H are measured along the surface 26. $H_m$ is the height of the club through the middle or the center of the club between the heel 29 and the toe 28. Preferably, $H_m$ is the maximum height distance of the club. $H_l$ and $H_2$ are the heights of the club approximately ½ the distance between the center of gravity CG and the toe 28 and the heel 29, respectively. Both $H_1$ and $H_2$ are greater than 70% of $H_m$ and are preferably between 85 and 95% of $H_m$. $H_3$ is the distance between hosel 22 and sole 33 and is preferably greater than 50% $H_m$. More preferably, $H_3$ is about 60% of $H_m$. In the preferred embodiment the golf club is configured such that line L is horizontally positioned at approximately one-half a standard ball diameter above ground G.

Furthermore, by locating the golf club hosel along a top edge 31 of the club head 21, the ball may be struck at any point along line L without the interference of hosel 22. Further, in combination with such construction, attaching hosel 22 at the upper top line surface 31 of head 21 provides a large striking surface along with hosel inset.

Moreover, in yet another preferred embodiment, the high density bar 36, as shown in FIGS. 6–8, can be incorporated into the club configuration of the third embodiment. Thus, the club may have three different average densities in the hosel portion 22, the body portion 42 and the sole portion 43. In this embodiment, the sole portion 43 has the greatest average density and the hosel portion 22 has the least average density.

While it is apparent that the invention herein disclosed in the various embodiments will provide many improvements, it will be appreciated that numerous modification and other embodiments may be made by those of ordinary skill in the art and it is intended that the appended claims cover such modification and embodiments that fall within the spirit and scope of the present invention.

We claim:

1. An iron golf club set, each club having club head center of gravity and a shaft, the shaft having a shaft axis, comprising: a plurality of clubs with varying lofts and insets, in which the inset of each club is equal to or less than the inset for the next club in the set with less club loft and there are at least three different insets within the set, wherein each club has an IC value, which is the perpendicular distance from the shaft axis to the club head center of gravity, and wherein the IC value of each club is inversely related to the inset of each club.

2. The iron golf club set of claim 1 wherein the plurality of clubs have offsets, in which the offset of each club is equal to or less than the offset for the next club in the set with less club loft and there are at least three different offsets within the set.

3. The iron golf club set of claim 1 wherein the plurality of clubs are comprised of long irons, middle irons and short irons, and the inset of each of the long irons is greater than 0.450 inch and the inset of each of the low irons is less than 0.450 inch.

4. The iron golf club set of claim 3 wherein the inset of each of the middle irons is between 0.350 and 0.600 inch and the inset of each of the low irons is between 0.250 and 0.450 inch.

5. The iron golf club set of claim 2 wherein the plurality of clubs are comprised of long irons, middle irons and short irons, and the combined inset and offset of each of the long irons is greater than 0.700 inch and the combined inset and offset of each of the low irons is less than 0.700 inch.

6. The iron golf club set of claim 5 wherein the combined inset and offset of each of the long irons is greater than 0.800 inch, the combined inset and offset of each of the middle irons is between 0.600 and 0.800 inch and the combined inset and offset of each of the low irons is less than 0.600 inch.

7. The iron golf club set of claim 1 wherein there are at least four different and progressive insets.

8. The iron golf club set of claim 1 wherein there are at least six different and progressive insets.

9. The iron golf club set of claim 2 wherein there are at least four different and progressive offsets.

10. The iron golf club set of claim 2 wherein there are at least six different and progressive offsets.

11. The iron golf club set of claim 2 wherein there are at least eight different and progressive offsets.

12. An iron golf club set comprising a plurality of clubs with varying lofts and insets, each club having a club head center of gravity and a shaft, the shaft having shaft axis, in which the inset of each club is equal to or lees than the inset for the next club in the set with less loft and there are at least three different insets within the set, wherein each club has an IC value, which is the perpendicular distance from the shaft axis to the club head center of gravity and wherein the IC value of each club is inversely related to the inset of each club and further having one such club further comprising:

a) head including a hosel, a heel, a toe, a sole, a top portion are composed of materials which have selected densities;

b) the sole composed of a material or materials having densities such that the average density of the sole is greater than the average density of the heel, toe and top portion.

13. An iron golf club set, each club having a club head center of gravity a shaft, the shaft having a shaft axis, comprising: a plurality of clubs with varying lofts and insets, in which the inset of each club is equal to or less than the inset for the next club in the set with less club loft and there are at least three different insets within the set, wherein each club has IC value, which is the perpendicular distance from the shaft axis to the club head center of gravity, and wherein the IC value of each club is inversely related to the inset each club and further having one such club further comprising:

a) head including a hosel, a heel, a toe, a sole, a top portion are composed of materials which have selected densities;

b) the hosel composed of a material or materials having densities such that the average density of the hosel is less than the average density of the heel, sole, toe and top portion.

14. An iron golf club set, each club having a club head center of gravity and a shaft, the shaft having a shaft axis, comprising a plurality of clubs with varying lofts and insets, in which the inset of each club is equal to or less than the inset for the next club in the set with less club loft and there are at least three different insets within the set, wherein each club has an IC value, which is the perpendicular distance from the shaft axis to the club head center of gravity, and wherein the IC value of each club is inversely related to the inset of each club and further having one such club further comprising:

a) head including a hosel, a heel, a toe, a sole, a top portion are composed of materials which have selected densities;

b) the sole composed of a material or materials having densities such that the average density of the sole is greater than the average density of the heel, toe and top portion;

(c) the hosel composed of a material or material having densities such that the average density of the hosel is less than the average density of the heel, sole, toe and top portion.

15. The iron golf club set of claim 1, wherein the IC value progressively changes from the clubs with less loft having a smaller IC value to the clubs with increased loft having a larger IC value.

16. The iron golf club set of claim 11, wherein the IC value progressively changes from the clubs with less loft having a smaller IC value to the clubs with increased loft having a larger IC value.

17. The iron golf club set of claim 12, wherein the IC value progressively changes from the clubs with less loft having a smaller IC value to the clubs with increased loft having a larger IC value.

18. The iron golf club set of claim 13, wherein the IC value progressively changes from the clubs with less loft having a smaller IC value to the clubs with increased loft having a larger IC value.

19. The iron golf club set of claim 14, wherein the IC value progressively changes from the clubs with less loft having a smaller IC value to the clubs with increased loft having a larger IC value.

* * * * *

UNITED STATES PATENT AND TRADEMARK OFFICE
CERTIFICATE OF CORRECTION

PATENT NO. : 5,607,363

DATED : March 4, 1997

INVENTOR : Arthur C.P. Chou

It is certified that error appears in the above-identified patent and that said Letters Patent is hereby corrected as shown below:

Column 6, line 31, between "having" and "shaft" insert --a--.
Column 6, line 32, change "lees" to --less--.
Column 6, line 36, after "gravity" insert --,--.
Column 6, line 52, after "has" insert --an--.
Column 6, line 54, after "inset" insert --of--.
Column 7, line 14, after "or" change "material" to --materials--.

Signed and Sealed this

Sixth Day of May, 1997

*Attest:*

Bruce Lehman

BRUCE LEHMAN

*Attesting Officer*

*Commissioner of Patents and Trademarks*